US010001302B2

(12) United States Patent
Hancock

(10) Patent No.: US 10,001,302 B2
(45) Date of Patent: Jun. 19, 2018

(54) PHASE CHANGE COMPRESSOR COVER

(71) Applicant: Trane International Inc., Piscataway, NJ (US)

(72) Inventor: Stephen Stewart Hancock, Flint, TX (US)

(73) Assignee: Trane International Inc., Piscataway, NJ (US)

( * ) Notice: Subject to any disclaimer, the term of this patent is extended or adjusted under 35 U.S.C. 154(b) by 754 days.

(21) Appl. No.: 14/577,614

(22) Filed: Dec. 19, 2014

(65) Prior Publication Data

US 2015/0192334 A1 Jul. 9, 2015

Related U.S. Application Data

(60) Provisional application No. 61/924,621, filed on Jan. 7, 2014.

(51) Int. Cl.

| | |
|---|---|
| ***F04D 11/00*** | (2006.01) |
| ***F25B 13/00*** | (2006.01) |
| ***F04C 29/04*** | (2006.01) |
| ***F04B 53/08*** | (2006.01) |
| ***F04C 18/02*** | (2006.01) |
| ***F25B 31/00*** | (2006.01) |
| *F04C 29/06* | (2006.01) |

(52) U.S. Cl.

CPC ..... *F25B 13/00* (2013.01); *F04B 53/08* (2013.01); *F04C 18/0207* (2013.01); *F04C 29/04* (2013.01); *F25B 31/006* (2013.01); *F04C 29/066* (2013.01); *F25B 2313/029* (2013.01); *F25B 2400/24* (2013.01); *F25B 2500/11* (2013.01); *F25B 2500/12* (2013.01); *F25B 2600/025* (2013.01)

(58) Field of Classification Search

CPC .. F25B 13/00; F25B 31/006; F25B 2313/029; F25B 2400/24; F25B 2500/11; F25B 2500/12; F25B 2600/025; F04B 53/08; F04C 18/0207; F04C 29/04; F04C 29/066

See application file for complete search history.

(56) References Cited

U.S. PATENT DOCUMENTS 5,272,285 A * 12/1993 Miller ..... F04B 39/0033 181/202

FOREIGN PATENT DOCUMENTS

CH 627538 A * 1/1982 ..... F04D 11/02

OTHER PUBLICATIONS

CH 627,538 A Machine Translation. Accessed EPO website Sep. 4, 2017. 7 pages.*

* cited by examiner

*Primary Examiner* — Richard Edgar
(74) *Attorney, Agent, or Firm* — Conley Rose, P.C.; J. Robert Brown, Jr.

(57) ABSTRACT

A phase change compressor cover may include a first layer configured to provide sound attenuation from undesirable noise produced as a result of operating a compressor and/or thermal isolation of the compressor and a second layer comprising a cavity filled with a phase change material that is configured to absorb heat discharged as a result of operating the compressor and subsequently discharge the absorbed heat onto the compressor in response to discontinuing operation of the compressor to keep the compressor warm and prevent refrigerant migration to the compressor. The phase change compressor cover may be used to substantially envelope the compressor in a heat pump heating, ventilation, and/or air conditioning (HVAC) system.

25 Claims, 5 Drawing Sheets

PHASE CHANGE COMPRESSOR COVER

CROSS-REFERENCE TO RELATED APPLICATIONS

The present application claims priority under 35 U.S.C. 119(e) to U.S. Provisional Patent Application No. 61/924,621 filed on Jan. 7, 2014 by Stephen Stewart Hancock, entitled "Phase Change Compressor Cover," the disclosure of which is hereby incorporated by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and/or air conditioning (HVAC) systems may generally comprise a compressor that may be selectively operated based on a demand for heating or cooling. Because refrigerant in an HVAC system may tend to migrate to colder locations in the system, refrigerant may often migrate to the compressor and become dissolved in the compressor oil when the compressor is not being operated. When the compressor is thereafter started, any refrigerant dissolved in the compressor oil may rapidly vaporize and carry oil away from bearing surfaces, which may cause damage and/or severely diminish the life of the compressor. Generally, migration of the refrigerant to the compressor may often be minimized by keeping the compressor warm. Current solutions for keeping the compressor warm may include utilizing small resistance heaters within the compressor and/or passing current through the compressor motor windings, both of which are energy inefficient.

SUMMARY

In some embodiments of the disclosure, a compressor cover is disclosed as comprising: a first layer comprising a first layer outer surface, a first layer inner surface, and a first layer base; and a second layer comprising a second layer outer wall comprising a second layer outer wall outer surface and a second layer outer wall inner surface, a second layer inner wall comprising a second layer inner wall outer surface and a second layer inner wall inner surface, and a second layer base comprising a second layer base outer surface and a second layer base inner surface, wherein the second layer outer wall inner surface, the second layer inner wall outer surface, and the second layer base inner surface form a second layer cavity.

In other embodiments of the disclosure, a compressor is disclosed as comprising a compressor cover comprising: a first layer comprising a first layer outer surface, a first layer inner surface, and a first layer base; and a second layer comprising a second layer outer wall comprising a second layer outer wall outer surface and a second layer outer wall inner surface, a second layer inner wall comprising a second layer inner wall outer surface and a second layer inner wall inner surface, and a second layer base comprising a second layer base outer surface and a second layer base inner surface, wherein the second layer outer wall inner surface, the second layer inner wall outer surface, and the second layer base inner surface form a second layer cavity, and wherein the first layer and the second layer are configured to substantially envelope the compressor.

In yet other embodiments of the disclosure, a method of heating a compressor is disclosed as comprising: providing a compressor comprising a compressor cover that substantially envelopes the compressor; operating the compressor; absorbing heat discharged as a result of operating the compressor into the compressor cover; and discharging heat from the compressor cover to the compressor when the compressor is not operating.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

In some cases, it may be desirable to provide an HVAC system with a compressor cover assembly comprising a phase change material. For example, where refrigerant may tend to migrate to a compressor and become dissolved in the compressor oil, it may be desirable to provide a compressor cover assembly comprising a phase change material that may absorb heat generated by the compressor during operation and slowly dissipate the stored heat back to the compressor to keep the compressor warm when the compressor is not being operated. In some embodiments, systems and methods are disclosed that comprise providing a compressor cover assembly comprising a phase change material that may be configured to absorb heat from the compressor and/or the heated refrigerant leaving the compressor and may be configured to slowly dissipate the heat to keep the compressor warm when the compressor is not being operated. In some embodiments, the phase change compressor cover may be used in an HVAC system, including, but not limited to, a heat pump system.

Figure 1:
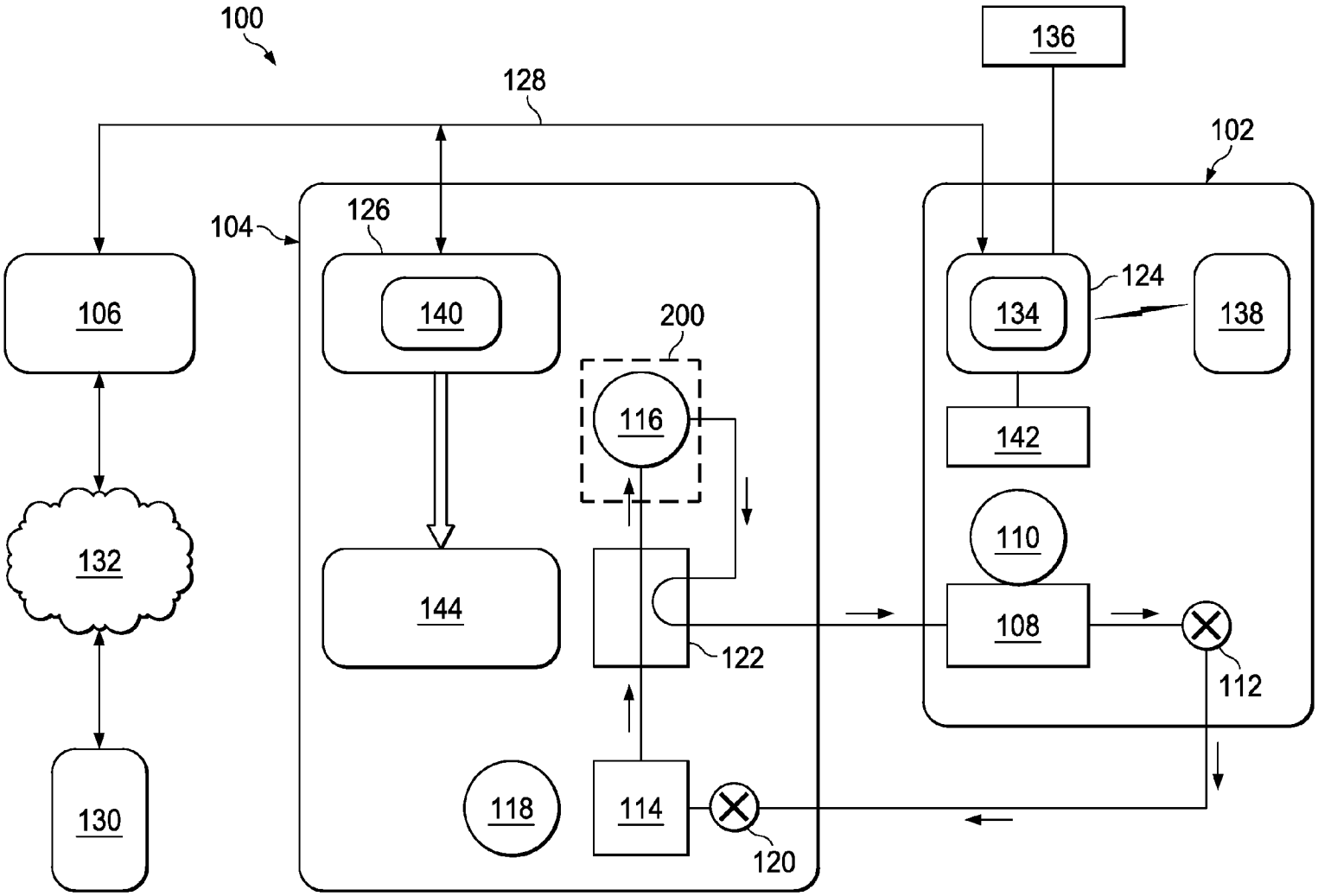
FIG. 1 is a schematic diagram of an HVAC system according to an embodiment of the disclosure.

Referring now to FIG. 1, a schematic diagram of an HVAC system 100 is shown according to an embodiment of the disclosure. HVAC system 100 generally comprises an indoor unit 102, an outdoor unit 104, and a system controller 106. The system controller 106 may generally control operation of the indoor unit 102 and/or the outdoor unit 104. As shown, the HVAC system 100 is a so-called heat pump system that may be selectively operated to implement one or more substantially closed thermodynamic refrigeration cycles to provide a cooling functionality and/or a heating functionality.

Indoor unit 102 generally comprises an indoor heat exchanger 108, an indoor fan 110, and an indoor metering device 112. Indoor heat exchanger 108 is a plate fin heat exchanger configured to allow heat exchange between refrigerant carried within internal tubing of the indoor heat exchanger 108 and fluids that contact the indoor heat exchanger 108 but that are kept segregated from the refrigerant. In other embodiments, indoor heat exchanger 108 may comprise a spine fin heat exchanger, a microchannel heat exchanger, or any other suitable type of heat exchanger.

The indoor fan 110 is a centrifugal blower comprising a blower housing, a blower impeller at least partially disposed within the blower housing, and a blower motor configured to selectively rotate the blower impeller. In other embodiments, the indoor fan 110 may comprise a mixed-flow fan and/or any other suitable type of fan. The indoor fan 110 is configured as a modulating and/or variable speed fan capable of being operated at many speeds over one or more ranges of speeds. In other embodiments, the indoor fan 110 may be configured as a multiple speed fan capable of being operated at a plurality of operating speeds by selectively electrically powering different ones of multiple electromagnetic windings of a motor of the indoor fan 110. In yet other embodiments, the indoor fan 110 may be a single speed fan.

The indoor metering device 112 is an electronically controlled motor driven electronic expansion valve (EEV). In alternative embodiments, the indoor metering device 112 may comprise a thermostatic expansion valve, a capillary tube assembly, and/or any other suitable metering device. The indoor metering device 112 may comprise and/or be associated with a refrigerant check valve and/or refrigerant bypass for use when a direction of refrigerant flow through the indoor metering device 112 is such that the indoor metering device 112 is not intended to meter or otherwise substantially restrict flow of the refrigerant through the indoor metering device 112.

Outdoor unit 104 generally comprises an outdoor heat exchanger 114, a compressor 116, an outdoor fan 118, an outdoor metering device 120, and a reversing valve 122. Outdoor heat exchanger 114 is a microchannel heat exchanger configured to allow heat exchange between refrigerant carried within internal passages of the outdoor heat exchanger 114 and fluids that contact the outdoor heat exchanger 114 but that are kept segregated from the refrigerant. In other embodiments, outdoor heat exchanger 114 may comprise a plate fin heat exchanger, a spine fin heat exchanger, or any other suitable type of heat exchanger.

The compressor 116 may generally be covered by a compressor cover, such as phase change compressor cover 200, and may generally comprise a multiple speed scroll type compressor configured to selectively pump refrigerant at a plurality of mass flow rates. In some embodiments, the compressor 116 may comprise a rotary type compressor configured to selectively pump refrigerant at a plurality of mass flow rates. In alternative embodiments, the compressor 116 may comprise a modulating compressor capable of operation over one or more speed ranges, a reciprocating type compressor, a single speed compressor, and/or any other suitable refrigerant compressor and/or refrigerant pump.

The outdoor fan 118 is an axial fan comprising a fan blade assembly and fan motor configured to selectively rotate the fan blade assembly. In other embodiments, the outdoor fan 118 may comprise a mixed-flow fan, a centrifugal blower, and/or any other suitable type of fan and/or blower. The outdoor fan 118 is configured as a modulating and/or variable speed fan capable of being operated at many speeds over one or more ranges of speeds. In other embodiments, the outdoor fan 118 may be configured as a multiple speed fan capable of being operated at a plurality of operating speeds by selectively electrically powering different ones of multiple electromagnetic windings of a motor of the outdoor fan 118. In yet other embodiments, the outdoor fan 118 may be a single speed fan.

The outdoor metering device 120 is a thermostatic expansion valve. In alternative embodiments, the outdoor metering device 120 may comprise an electronically controlled motor driven EEV similar to indoor metering device 112, a capillary tube assembly, and/or any other suitable metering device. The outdoor metering device 120 may comprise and/or be associated with a refrigerant check valve and/or refrigerant bypass for use when a direction of refrigerant flow through the outdoor metering device 120 is such that the outdoor metering device 120 is not intended to meter or otherwise substantially restrict flow of the refrigerant through the outdoor metering device 120.

The reversing valve 122 is a so-called four-way reversing valve. The reversing valve 122 may be selectively controlled to alter a flow path of refrigerant in the HVAC system 100 as described in greater detail below. The reversing valve 122 may comprise an electrical solenoid or other device configured to selectively move a component of the reversing valve 122 between operational positions.

The system controller 106 may generally comprise a touchscreen interface for displaying information and for receiving user inputs. The system controller 106 may display information related to the operation of the HVAC system 100 and may receive user inputs related to operation of the HVAC system 100. However, the system controller 106 may further be operable to display information and receive user inputs tangentially and/or unrelated to operation of the HVAC system 100. In some embodiments, the system controller 106 may not comprise a display and may derive all information from inputs from remote sensors and remote configuration tools. In some embodiments, the system controller 106 may comprise a temperature sensor and may further be configured to control heating and/or cooling of zones associated with the HVAC system 100. In some embodiments, the system controller 106 may be configured as a thermostat for controlling supply of conditioned air to zones associated with the HVAC system 100.

In some embodiments, the system controller 106 may also selectively communicate with an indoor controller 124 of the indoor unit 102, with an outdoor controller 126 of the outdoor unit 104, and/or with other components of the HVAC system 100. In some embodiments, the system controller 106 may be configured for selective bidirectional communication over a communication bus 128. In some embodiments, portions of the communication bus 128 may comprise a three-wire connection suitable for communicating messages between the system controller 106 and one or more of the HVAC system 100 components configured for interfacing with the communication bus 128. Still further, the system controller 106 may be configured to selectively communicate with HVAC system 100 components and/or any other device 130 via a communication network 132. In some embodiments, the communication network 132 may comprise a telephone network, and the other device 130 may comprise a telephone. In some embodiments, the communication network 132 may comprise the Internet, and the other device 130 may comprise a smartphone and/or other Internet-enabled mobile telecommunication device. In other embodiments, the communication network 132 may also comprise a remote server.

The indoor controller 124 may be carried by the indoor unit 102 and may be configured to receive information inputs, transmit information outputs, and otherwise communicate with the system controller 106, the outdoor controller 126, and/or any other device 130 via the communication bus 128 and/or any other suitable medium of communication. In some embodiments, the indoor controller 124 may be configured to communicate with an indoor personality module 134 that may comprise information related to the identification and/or operation of the indoor unit 102. In some embodiments, the indoor controller 124 may be configured to receive information related to a speed of the indoor fan 110, transmit a control output to an electric heat relay, transmit information regarding an indoor fan 110 volumetric flow-rate, communicate with and/or otherwise affect control over an air cleaner 136, and communicate with an indoor EEV controller 138. In some embodiments, the indoor controller 124 may be configured to communicate with an indoor fan controller 142 and/or otherwise affect control over operation of the indoor fan 110. In some embodiments, the indoor personality module 134 may comprise information related to the identification and/or operation of the indoor unit 102 and/or a position of the outdoor metering device 120.

In some embodiments, the indoor EEV controller 138 may be configured to receive information regarding temperatures and/or pressures of the refrigerant in the indoor unit 102. More specifically, the indoor EEV controller 138 may be configured to receive information regarding temperatures and pressures of refrigerant entering, exiting, and/or within the indoor heat exchanger 108. Further, the indoor EEV controller 138 may be configured to communicate with the indoor metering device 112 and/or otherwise affect control over the indoor metering device 112. The indoor EEV controller 138 may also be configured to communicate with the outdoor metering device 120 and/or otherwise affect control over the outdoor metering device 120.

The outdoor controller 126 may be carried by the outdoor unit 104 and may be configured to receive information inputs, transmit information outputs, and otherwise communicate with the system controller 106, the indoor controller 124, and/or any other device via the communication bus 128 and/or any other suitable medium of communication. In some embodiments, the outdoor controller 126 may be configured to communicate with an outdoor personality module 140 that may comprise information related to the identification and/or operation of the outdoor unit 104. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116. In some embodiments, the outdoor controller 126 may be configured to transmit information related to monitoring, communicating with, and/or otherwise affecting control over the outdoor fan 118, a compressor sump heater, a solenoid of the reversing valve 122, a relay associated with adjusting and/or monitoring a refrigerant charge of the HVAC system 100, a position of the indoor metering device 112, and/or a position of the outdoor metering device 120. The outdoor controller 126 may further be configured to communicate with a compressor drive controller 144 that is configured to electrically power and/or control the compressor 116.

The HVAC system 100 is shown configured for operating in a so-called heating mode in which heat is absorbed by a refrigerant at the outdoor heat exchanger 114 and heat is rejected by refrigerant at the indoor heat exchanger 108. In some embodiments, the compressor 116 may be operated to compress refrigerant and pump the relatively high temperature and high pressure compressed refrigerant from the compressor 116 to the indoor heat exchanger 108 through the reversing valve 122. From the indoor heat exchanger 108, the refrigerant may be pumped unaffected through the indoor metering device 112 to the outdoor metering device 120 and ultimately to the outdoor heat exchanger 114. The refrigerant may experience a pressure differential across the outdoor metering device 120, be passed through the outdoor heat exchanger 114, and ultimately reenter the compressor 116. As the refrigerant is passed through the outdoor heat exchanger 114, the outdoor fan 118 may be operated to move air into contact with the outdoor heat exchanger 114, thereby transferring heat from the air surrounding the outdoor heat exchanger 114 to the refrigerant. The refrigerant may thereafter re-enter the compressor 116 after passing through a second internal passage within the reversing valve 122.

Alternatively, to operate the HVAC system 100 in a so-called cooling mode, most generally, the roles of the indoor heat exchanger 108 and the outdoor heat exchanger 114 are reversed as compared to their operation in the above-described heating mode. For example, the reversing valve 122 may be controlled to alter the flow path of the refrigerant, the indoor metering device 112 may be enabled, and the outdoor metering device 120 may be disabled and/or bypassed. In cooling mode, heat is absorbed by refrigerant at the indoor heat exchanger 108 and heat is rejected by the refrigerant at the outdoor heat exchanger 114. As the refrigerant is passed through the indoor heat exchanger 108, the indoor fan 110 may be operated to move air into contact with the indoor heat exchanger 108, thereby transferring heat to the refrigerant from the air surrounding the indoor heat exchanger 108.

Figure 2:
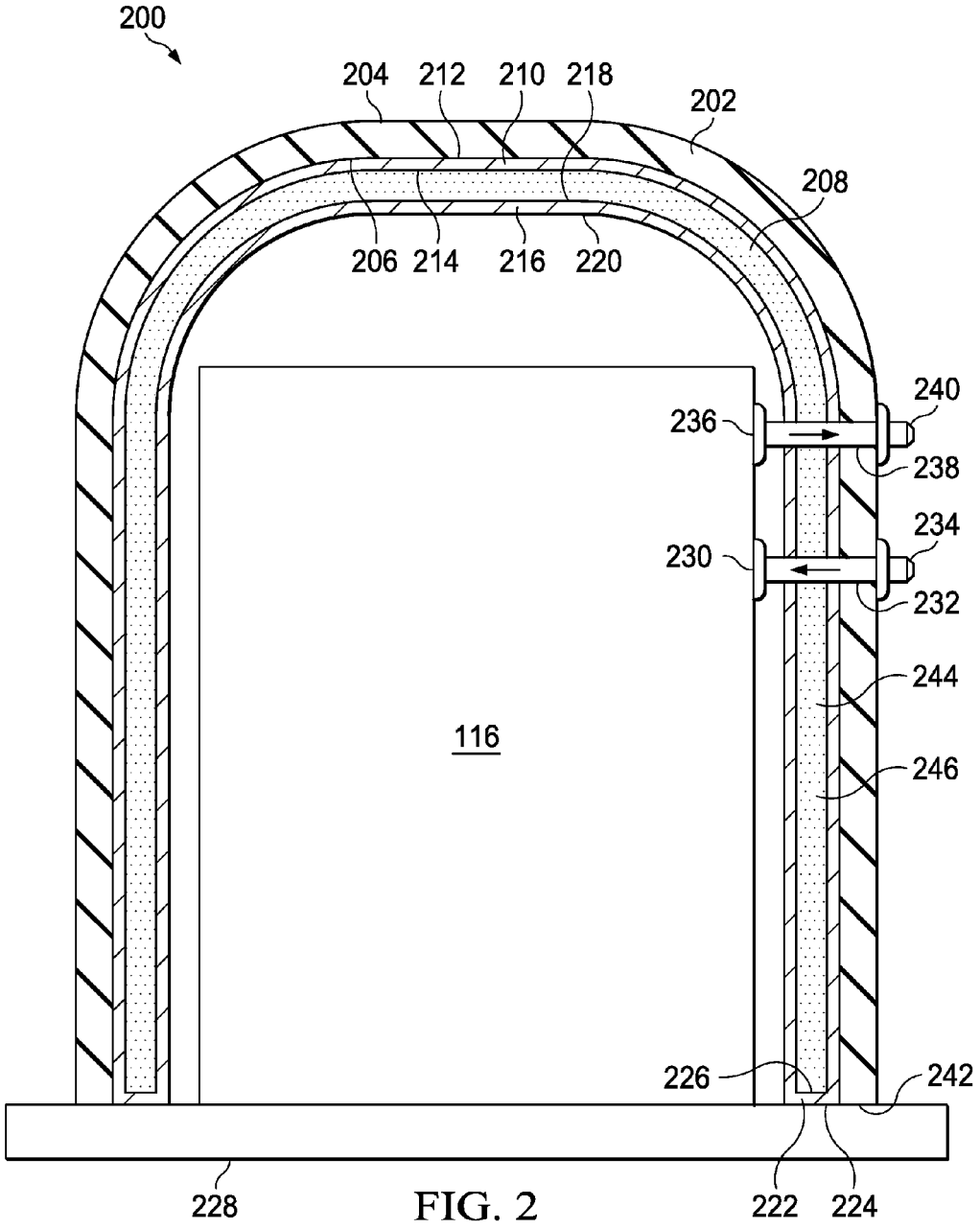
FIG. 2 is a partial cutaway view of a compressor comprising a phase change compressor cover according to an embodiment of the disclosure.

Referring now to FIG. 2, a partial cutaway view of a compressor 116 comprising a phase change compressor cover 200 is shown according to an embodiment of the disclosure. The phase change compressor cover 200 may generally comprise an insulative layer 202 and a phase change layer 208. The insulative layer 202 may generally comprise an insulative layer outer surface 204 which may form the outer boundary of the phase change compressor cover 200. The insulative layer 202 may also comprise an insulative layer inner surface 206. The distance between the insulative layer outer surface 204 and the insulative layer inner surface 206 may generally be referred to as the thickness of the insulative layer 202. The insulative layer 202 may also comprise an insulative layer base 242, which may, in some embodiments, be configured to abut a support surface 228 that may generally provide support to the compressor 116. In some embodiments, the insulative layer 202 may generally comprise a substantially cylindrically-shaped lower portion that annularly surrounds the compressor 116. In some embodiments, the insulative layer 202 may comprise a radiused transition from the substantially cylindrically-shaped lower portion to a substantially flat upper portion of the insulative layer 202. In other embodiments, however, the insulative layer 202 may comprise a substantially dome-shaped upper portion. In yet other embodiments, the insulative layer 202 may comprise any suitable shape that may be substantially complimentary to the compressor 116.

The insulative layer 202 may generally be configured to provide sound attenuation to undesirable noise produced by the compressor 116 when the compressor 116 is operating. As will be discussed later, the insulative layer 202 may also reduce heat transfer between the phase change layer 208 and the environment. Accordingly, the insulative layer 202 may generally comprise a thickness that is conducive to absorbing and/or attenuating any undesirable noise that may be produced by the compressor 116 during operation. Additionally, the insulative layer 202 may be formed from a material capable of dampening sound as well as providing thermal insulation. In some embodiments, the insulative layer 202 may be formed from a rigid and/or non-rigid, composite material, including, but not limited to a fiberglass composite. In other embodiments, the insulative layer 202 may be formed from high-density foam, such as polystyrene foam (i.e. Styrofoam) and/or any other suitable material. In yet other embodiments, the insulative layer 202 may comprise an insulative layer outer surface 204, an insulative layer inner surface 206, and an insulative layer base 242 that may be formed from a rigid and/or non-rigid, composite material, such as fiberglass, that may be filled with high-density foam, such as polystyrene foam. In some embodiments, the insulative layer 202 may comprise a thickness of at least about 0.25", about 0.5", about 0.75", about 1.0", about 1.25", and/or about 1.5".

The phase change layer 208 may generally comprise a phase change outer wall 210 and a phase change inner wall 216. The phase change outer wall 210 may comprise a phase change outer wall outer surface 212 and a phase change outer wall inner surface 214. The distance between the phase change outer wall outer surface 212 and the phase change outer wall inner surface 214 may generally be referred to as the thickness of the phase change outer wall 210. The phase change inner wall 216 may comprise a phase change inner wall outer surface 218 and a phase change inner wall inner surface 220. The distance between the phase change inner wall outer surface 218 and the phase change inner wall inner surface 220 may generally be referred to as the thickness of the phase change inner wall 216. The phase change layer 208 may also comprise a phase change base 222 having phase change base outer surface 224 and a phase change base inner surface 226. The distance between the phase change base outer surface 224 and the phase change base inner surface 226 may generally be referred to as the thickness of the phase change base 222. In some embodiments, the phase change base 222 may be configured such that the phase change base outer surface 224 abuts the support surface 228. Collectively, the phase change outer wall inner surface 214, the phase change inner wall outer surface 218, and the phase change base inner surface 226 may define a cavity 244 that may be filled with a phase change material 246.

The phase change layer 208 may generally be configured to absorb heat discharged by the compressor 116 when the compressor 116 is operating and dissipate the stored heat to keep the compressor 116 warm when the compressor 116 is not operating. Accordingly, the phase change layer 208 may generally comprise a structure and/or thickness that may hold a sufficient amount of phase change material 246 within the phase change cavity 244 in order to absorb a sufficient amount of heat that may be used to keep the compressor 116 warm when the compressor 116 is not operated. Thus, the phase change inner wall 216 may comprise a thickness that may promote heat exchange between the phase material 246 and the compressor 116, while the phase change outer wall 210 may comprise a thickness that may prevent heat stored in the phase change material 246 from being dissipated outward and lost to the environment. In some embodiments, the phase change inner wall 216, phase change outer wall 210, and/or the phase change base 222 may comprise a thickness that may accommodate any pressure change that may occur within the phase change cavity 244. In some embodiments, the phase change inner wall 216 and/or the phase change outer wall 210 may also comprise a thickness that may provide additional sound attenuation to any undesirable noise produced by the compressor 116.

The phase change layer 208 may generally be formed from a material that may promote heat transfer between the phase change material 246 and the compressor 116. In some embodiments, the phase change layer 208 may be formed from a rigid composite material, including, but not limited to a fiberglass composite. In some embodiments, the phase change layer 208 may comprise phase change outer wall 210 formed from a rigid composite material, such as fiberglass, while the phase change inner wall 216 may be formed from a flexible material that may conform to fluctuations in the state, volume, and/or temperature of the phase change material 246. In other embodiments, the phase change layer 208 may be formed from aluminum, and/or any other suitable material configured to promote and/or at least not restrict heat transfer between the phase change material 246 and the compressor 116. In some embodiments, the phase change layer 208 may be formed from a material that may provide additional sound attenuation to any undesirable noise produced by the compressor 116.

The phase change material 246 may generally be contained within the phase change cavity 244 and configured to absorb heat discharged by the compressor 116 when the compressor 116 is operating and dissipate the stored heat to keep the compressor 116 warm when the compressor 116 is not operating. The phase change material 246 may generally be a substance with a high heat of fusion and a liquid/solid transition temperature below typical compressor discharge temperature (120-150 F) but above typical conditioned space temperatures (70-80 F), and which may melt and solidify as a result of exposing the phase change material 246 to heat generated by the compressor 116. In some embodiments, the phase change material 246 may substantially fill the phase change cavity 244. In other embodiments, the phase change material 246 may not fill the phase change cavity 244 in order to account for volumetric changes in the phase change material 246 caused by temperature and/or pressure changes. In some embodiments, the phase change layer 208 may comprise a phase change cavity 244 configured to store a phase change material 246 comprising a thickness of at least 0.5 inches, at least 0.75 inches, at least 1 inch, at least 1.25 inches, and/or at least 1.5 inches. The phase change material 246 may generally comprise a thermal storage medium that is configured to absorb heat when exposed to a thermal energy source (i.e. discharge from compressor 116) and subsequently slowly dissipate the stored heat when the thermal energy source is no longer emitting thermal energy. In some embodiments, the phase change material 246 may comprise paraffin wax. In some embodiments, the phase change material may comprise any other suitable solid and/or liquid thermal storage medium.

The phase change layer 208 may generally comprise a substantially complimentary shape to that of the insulative layer 202. The phase change layer 208 may generally be located inside and bounded by the insulative layer 202. More specifically, the phase change layer 208 may generally be located inwardly adjacent to the insulation layer 202 such that the insulative layer inner surface 206 substantially abuts the phase change outer wall outer surface 212 of phase change outer wall 210 of the phase change layer 208. In some embodiments, the phase change layer 208 may be configured such that the phase change base outer surface 224 may be substantially coincident with the insulative layer base 242. Accordingly, in some embodiments, the phase change base outer surface 224 and/or the insulative layer base 242 may substantially abut the support surface 228.

In some embodiments, the phase change layer 208 and the insulative layer 202 may generally be formed separately and then assembled. In some embodiments, the phase change layer 208 and the insulative layer 202 may be held together by mechanical hardware, such as screws, rivets, nuts and bolts and/or any other mechanical fastening hardware. In some embodiments, the phase change layer 208 and the insulative layer 202 may be assembled and held together with an adhesive. In other embodiments, the phase change layer 208 and the insulative layer 202 may comprise an interference fit and be press fit together. In other embodiments, the phase change outer wall (210) and the insulative layer inner wall (206) may coincide. In yet other embodiments, the phase change layer 208 and the insulative layer 202 may be formed from substantially the same material such that the phase change outer wall 210 of the phase change layer and the insulative layer form a substantially cohesive, non-delineated phase change compressor cover 200. In some embodiments, the phase change compressor cover 200 may be comprise a phase change inner wall 216 profile that is substantially complimentary to the profile of the compressor 116. In some embodiments, the phase change inner wall inner surface 220 of the phase change compressor cover 200 may substantially abut an outer surface the compressor 116. In some embodiments, however, the phase change inner wall inner surface 220 of the phase change compressor cover 200 may not contact the compressor 116.

While the phase change layer 208 and the insulative layer 202 may collectively form the phase change compressor cover 200 that may substantially cover the compressor 116, the phase change layer 208 and the insulative layer 202 may be configured to allow ingress and egress of refrigerant to and from the compressor 116. The compressor 116 may generally comprise at least one inlet 230 and at least one outlet 236. Accordingly, to allow ingress and egress of the refrigerant through the phase change layer 208 and the insulative layer 202, the phase change compressor cover 200 may comprise at least one inlet connection 234 and at least one outlet connection 240. The inlet 230 of the compressor 116 may generally be joined in fluid communication to the inlet connection 234 of the phase change compressor cover 200 through at least one inlet tube 232, while the outlet 236 of the compressor 116 may generally be joined in fluid communication to the outlet connection 240 of the phase change compressor cover 200 through at least one outlet tube 238. Additionally, the compressor cover 200 may be configured such that it may be installed or removed without disturbing the compressor 116 and any of its associated plumbing (i.e. inlet tube 232 and/or outlet tube 238).

Still referring to FIG. 2, the phase change compressor cover 200 may generally be configured to cover the compressor 116 to provide both sound attenuation during operation in addition to heat retention and dissipation when the compressor 116 is not operating. When the compressor 116 is operated, the compressor 116 may continuously emit heat. The emitted heat may be caused by friction of the components within the compressor 116, motor windings within the compressor 116, and/or heated refrigerant exiting the compressor 116. The heat emitted by the compressor 116 may continuously be absorbed by the phase change material 246 contained within the phase change layer 208 while the compressor 116 is operated until the phase change material 246 temperature is in equilibrium with the compressor 116 discharge. Upon cessation of operation of the compressor 116, the compressor 116 may cease to substantially emit additional heat.

As the compressor 116 remains inoperative, the compressor 116 may also begin to cool and substantially reduce its temperature. Additionally, upon cessation of the operation of the compressor 116, the phase change layer 246 may begin to dissipate the stored heat and cool very slowly. In order to keep the cooling compressor 116 warm and prevent refrigerant from migrating to the compressor 116, the phase change compressor cover 200 may generally be configured such that the phase change material 246 dissipates the stored heat to the compressor 116. The phase change material 246 may continuously slowly dissipate the heat towards the compressor 116 for an extended period of time, thereby reducing and/or alleviating the need for an auxiliary heat source to heat the compressor 116. In some embodiments, the phase change material may continuously dissipate at least about 20 Watts of thermal energy, at least about 30 Watts of thermal energy, at least about 40 Watts of thermal energy, at least about 50 Watts of thermal energy, and/or at least about 60 Watts of thermal energy. In some embodiments, the phase change material 246 may dissipate a continuous thermal energy output for at least about 6 hours, at least about 12 hours, at least about 18 hours, at least about 24 hours, at least about 48 hours, and/or at least about 72 hours. The phase change material 246, the thickness of phase change material 246, and/or the dimensions of the phase change cavity 244 may be configured based on a desired amount of continuous thermal energy output and/or desired length of time the phase change material 246 may output the continuous power output. For example, in some embodiments, a 1" thick layer of phase change material 246 may generally provide at least about 40 Watts of thermal energy for at least about 12 hours.

In some embodiments, the phase change compressor cover 200 may obviate the need for auxiliary heat, such as resistive sump heat. In other embodiments, the phase change compressor cover 200 may reduce and/or delay the need for auxiliary heat. For instance, where a 1" thick layer of phase change material 246 may provide at least about 40 Watts of continuous thermal energy for a time period of at least about 12 hours, auxiliary heat may not be needed for at least that 12 hour period of time. In some embodiments, however, the same layer of phase change material 246 may delay the need for auxiliary for a substantially longer period of time. Additionally, in some embodiments, the compressor 116 may be operated upon the need for auxiliary heat in order to provide heat into the phase change layer 208 of the phase change compressor cover 200. In some embodiments, operating the compressor 116 to induce heat into the phase change layer 208 may be triggered by a controller, such as controllers 106, 124, 126 that may be configured to monitor a temperature sensor that may be configured to monitor the temperature of the compressor. The phase change compressor cover 200 may generally provide a more efficient solution for keeping the compressor 116 warm when the compressor 116 is not being operated because the phase change compressor cover 200 may keep the compressor 116 warm while consuming no off-cycle power. Accordingly, the phase change compressor cover 200 may provide at least about 2-10 times the efficiency of an auxiliary heat source from the phase change layer 208 while still providing noise attenuation from the insulative layer 202. Operating the compressor 116 to induce heat into the phase change layer 208 may also provide a more efficient solution to keeping the compressor 116 warm than employing the auxiliary heat source.

Figure 3:
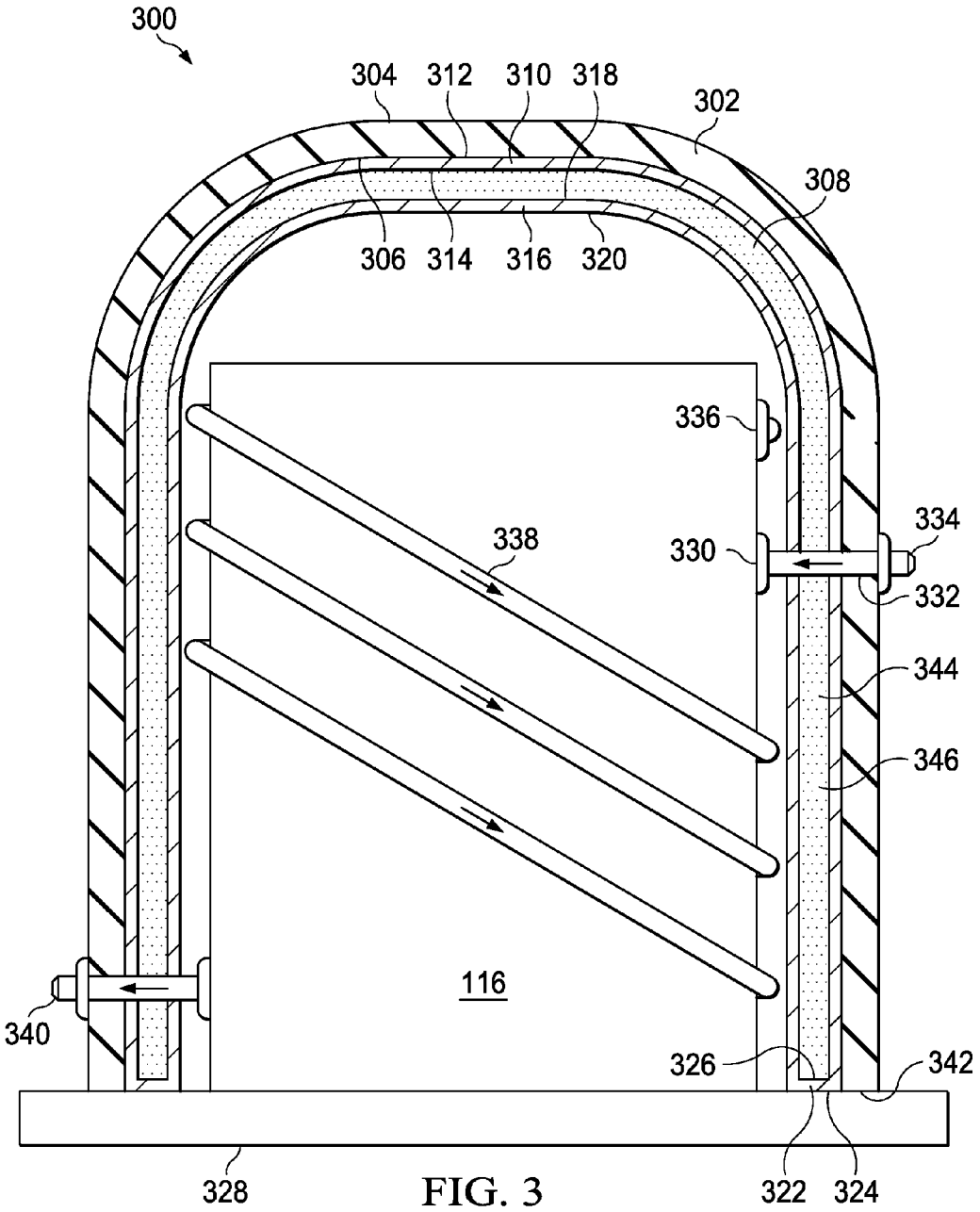
FIG. 3 is a partial cutaway view of a compressor comprising a phase change compressor cover according to another embodiment of the disclosure.

Referring now to FIG. 3, a partial cutaway view of a compressor 116 comprising a phase change compressor cover 300 is shown according to another embodiment of the disclosure. Phase change compressor cover 300 may generally be substantially similar to phase change compressor cover 200 in FIG. 2. Phase change compressor cover 300 may comprise an insulative layer 302 and a phase change layer 308 that may be configured substantially similar to the insulative layer 202 and the phase change layer 208 in FIG. 2, respectively. The insulative layer 302 may comprise an insulative layer outer surface 304, an insulative layer inner surface 306, and an insulative layer base 342. In some embodiments, the insulative layer base 342 may be configured to abut a support surface 328 that may generally provide support to the compressor 116. The phase change layer 308 may comprise a phase change outer wall 310 comprising a phase change outer wall outer surface 312 and a phase change outer wall inner surface 314, a phase change inner wall 316 having a phase change inner wall outer surface 318 and a phase change inner wall inner surface 320, and a phase change base 322 comprising a phase change base outer surface 324 and a phase change base inner surface 326. Collectively, the phase change outer wall inner surface 314, the phase change inner wall outer surface 318, and the phase change base inner surface 326 may define a cavity 344 that may be filled with a phase change material 346.

While the phase change layer 308 and the insulative layer 302 may collectively form the phase change compressor cover 300 that may substantially cover the compressor 116, the phase change layer 308 and the insulative layer 302 may be configured to allow ingress and egress of refrigerant to and from the compressor 116. The compressor 116 may generally comprise at least one inlet 330 and at least one outlet 336. Accordingly, to allow ingress and egress of the refrigerant through the phase change layer 308 and the insulative layer 302, the phase change compressor cover 300 may comprise at least one inlet connection 334 and at least one outlet connection 340. The inlet 330 of the compressor 116 may generally be joined in fluid communication to the inlet connection 334 of the phase change compressor cover 300 through at least one inlet tube 332, while the outlet 336 of the compressor 116 may generally be joined in fluid communication to the outlet connection 340 of the phase change compressor cover 300 through at least one outlet tube 338. It will be appreciate that inlet 330, inlet tube 330, inlet tube connection 334, outlet 336, outlet tube 338, and outlet tube connection 340 may be substantially similar to the inlet 230, inlet tube 230, inlet tube connection 234, outlet 236, outlet tube 238, and outlet tube connection 240 of FIG. 2, respectively.

However, outlet tube 338 may generally be helically wound around the compressor 116. The outlet tube 338 may generally be configured to be wrapped around the compressor 116 and be substantially located between the compressor 116 and the phase change inner wall inner surface 320 of the phase change layer 308. The outlet tube 338 may generally be located substantially close to the compressor 116 and/or the phase change inner wall inner surface 320. Thus, in some embodiments, the phase change compressor cover 300 may comprise a phase change inner wall 316 profile that is substantially complimentary to the profile of the compressor 116 and/or the outlet tube 338. In some embodiments, the phase change inner wall inner surface 320 of the phase change compressor cover 300 may substantially abut an outer surface the compressor 116, while the phase change inner wall 316 may comprise a helical channel configured to receive the outlet tube 338. In some embodiments, however, the phase change inner wall inner surface 320 of the phase change layer 308 may not contact the compressor 116 and/or the outlet tube 338.

The outlet tube 338 may generally be configured to carry refrigerant from the outlet 336 of the compressor 116 to the outlet connection 340 of the phase change compressor cover 300. In some embodiments, the outlet tube 338 may be configured to connect to the outlet 336 at the top of the compressor 116 and wind helically downward to the outlet connection 340 located substantially near the bottom of the phase change compressor cover 300. Alternatively, in some embodiments, the outlet tube 338 may be configured to connect to the outlet 336 at the bottom of the compressor 116 and wind helically upward to the outlet connection 340 located substantially near the top of the phase change compressor cover 300. Still, in other embodiments, the outlet tube 338 may connect to the outlet 336 at any location on the compressor 116 and helically wind around the compressor 116 to the outlet connection 340 located at any location on the phase change compressor cover 300. It will be appreciated that outlet tube 338 may be formed from copper, aluminum, stainless steel, and/or any other suitable material that may be configured to carry refrigerant from the outlet 336 of the compressor 116 to the outlet connection 340.

In operation, the helically-wound outlet tube 338 may be configured to enhance heat transfer to the phase change material 346. Refrigerant discharged by the compressor 116 and carried by the outlet tube 338 may generally reach temperatures of about 150° F. Additionally, the outlet tube 338 may absorb some heat from the refrigerant. Because the outlet tube 338 may be helically wound around the compressor 116 and be substantially closely located to the compressor 116 and/or the phase change inner wall inner surface 320, heat carried by the refrigerant and/or heat carried by the outlet tube 338 may be transferred to the phase change material 346 of the phase change layer 308. In some embodiments, locating the outlet tube 338 helically around the compressor 116 may impart an additional amount of heat into the phase change material 346 as compared to an outlet tube, such as outlet tube 238 that exits straight from the compressor 116 and may only impart a nominal amount of heat into a phase change material 346. In some embodiments, additional heat imparted by the helically-wound outlet tube 338 may enable the phase change material 346 to continuously omit a higher thermal energy output as compared to a phase change layer that did not receive additional heat from the outlet tube 338. Additionally, in some embodiments, the phase change material 346 may comprise the ability to continuously output a thermal energy output for a longer period of time as compared to a phase change layer that did not receive additional heat from the outlet tube 338. It will be appreciated that while outlet tube 338 is shown helically wound around the compressor 116 about 3 times, a substantially shorter outlet tube 338 may be required, and the excess outlet tube 338 is shown to illustrate the configuration of outlet tube 338 as a heat source.

Figure 4:
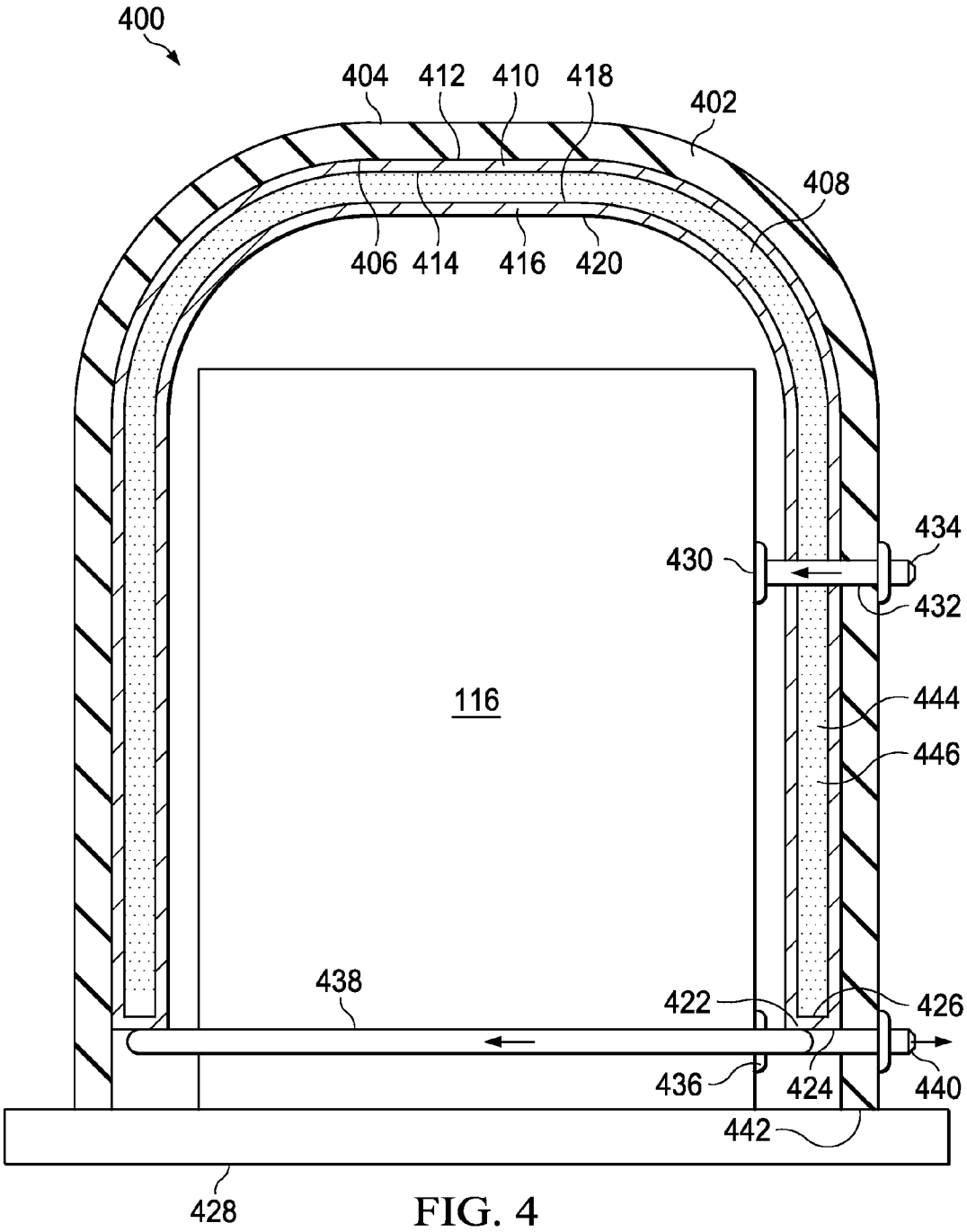
FIG. 4 is a partial cutaway view of a compressor comprising a phase change compressor cover according to yet another embodiment of the disclosure.

Referring now to FIG. 4, a partial cutaway view of a compressor 116 comprising a phase change compressor cover 400 is shown according to yet another embodiment of the disclosure. Phase change compressor cover 400 may generally be substantially similar to phase change compressor cover 300 in FIG. 3. Phase change compressor cover 400 may comprise an insulative layer 402 and a phase change layer 408 that may be configured substantially similar to the insulative layer 302 and the phase change layer 308 in FIG. 3, respectively. The insulative layer 402 may comprise an insulative layer outer surface 404, an insulative layer inner surface 406, and an insulative layer base 442. In some embodiments, the insulative layer base 442 may be configured to abut a support surface 428 that may generally provide support to the compressor 116. The phase change layer 408 may comprise a phase change outer wall 410 comprising a phase change outer wall outer surface 412 and a phase change outer wall inner surface 414, a phase change inner wall 416 having a phase change inner wall outer surface 418 and a phase change inner wall inner surface 420, and a phase change base 422 comprising a phase change base outer surface 424 and a phase change base inner surface 426. However, the phase change base 422 may not be coplanar with the insulative layer base 442, and in some embodiments, may allow clearance for an outlet tube 438 that may encircle and/or be helically wound around the compressor 116. Collectively, the phase change outer wall inner surface 414, the phase change inner wall outer surface 418, and the phase change base inner surface 426 may define a cavity 444 that may be filled with a phase change material 446.

While the phase change layer 408 and the insulative layer 402 may collectively form the phase change compressor cover 400 that may substantially cover the compressor 116, the phase change layer 408 and/or the insulative layer 402 may be configured to allow ingress and egress of refrigerant to and from the compressor 116. The compressor 116 may generally comprise at least one inlet 430 and at least one outlet 436. Accordingly, to allow ingress and egress of the refrigerant through the phase change layer 408 and/or the insulative layer 402, the phase change compressor cover 400 may comprise at least one inlet connection 434 and at least one outlet connection 440. The inlet 430 of the compressor 116 may generally be joined in fluid communication to the inlet connection 434 of the phase change compressor cover 400 through at least one inlet tube 432, while the outlet 436 of the compressor 116 may generally be joined in fluid communication to the outlet connection 440 of the phase change compressor cover 400 through at least one outlet tube 438. It will be appreciate that inlet 430, inlet tube 430, inlet tube connection 434, outlet 436, outlet tube 438, and outlet tube connection 440 may be substantially similar to the inlet 330, inlet tube 330, inlet tube connection 334, outlet 336, outlet tube 338, and outlet tube connection 340 of FIG. 3, respectively.

However, the outlet tube 438 may generally be helically wound around a lower end of the compressor 116. In some embodiments, the outlet tube 438 may encircle and/or be helically wound around the compressor 116 at a lower end of the compressor 116. In some embodiments, the outlet 436 may be located near a lower end of the compressor 116, and outlet tube 438 may exit the compressor 116 through the outlet 436 and substantially encircle the lower end of the compressor 116, such that the outlet tube 438 substantially bounds a lower end of the compressor 116 by making substantially a full revolution around an exterior of the compressor 116 and exits the phase change compressor cover 400 through the insulative layer 402 via the outlet connection 440 on substantially the same side as the outlet 436. In some embodiments, the outlet 436 may be located near an upper end of the compressor 116, and the outlet tube 438 may exit the compressor through the outlet 436, extend downward to a lower end of the compressor 116, and extend substantially around the lower portion of the compressor 116, where it may exit the phase change compressor cover 400 through the insulative layer 402 near the lower end of the compressor 116. In some embodiments, however, the outlet tube 438 may exit through an aperture and/or any cutout section of the insulative layer 402 configured to allow the outlet tube 438 to exit the phase change compressor cover 400. The outlet tube 438 may generally be configured to be wrapped around the compressor 116 and be substantially located between the compressor 116 and the insulative layer 402. It will be appreciated that outlet tube 438 may generally be formed from copper, aluminum, stainless steel, and/or any other suitable material that may be configured to carry refrigerant from the outlet 436 of the compressor 116 to the outlet connection 440 of the phase change compressor cover 400.

Additionally, the phase change layer 408 may be configured to allow a clearance for the outlet tube 438. In some embodiments, the phase change layer 408 may be disposed immediately above the outlet tube 438. In some embodiments, the phase change layer 408 may be in contact with the outlet tube 438, such that the phase change base outer surface 424 substantially abuts the outlet tube 438. In some embodiments, the phase change base 422 and/or the phase change base outer surface 424 may comprise a substantially complimentary shape to the outlet tube 438. The outlet tube 338 may generally be located substantially close to the compressor 116 and/or the insulative layer inner surface 406. Thus, in some embodiments, the phase change compressor cover 400 may comprise an insulative layer inner wall 406 profile that is substantially complimentary to the profile of the compressor 116 and/or the outlet tube 438. In some embodiments, the phase change inner wall inner surface 420 of the phase change compressor cover 400 may substantially abut an outer surface the compressor 116, while the phase change base 422 may substantially abut the outlet tube 338. In some embodiments, however, the phase change inner wall inner surface 320 of the phase change layer 208 may not contact the compressor 116 and may provide a minimal clearance.

In operation, the helically-wound outlet tube 438 may be configured to enhance heat transfer to the phase change material 446. Refrigerant discharged by the compressor 116 and carried by the outlet tube 338 may generally reach temperatures of about 150° F. Additionally, the outlet tube 438 may absorb some heat from the refrigerant. Because the outlet tube 438 may be helically wound around the compressor 116 and be substantially closely located to and/or substantially abut the compressor 116 and/or the phase change base outer surface 424, heat carried by the refrigerant and/or heat carried by the outlet tube 438 may be transferred to the phase change material 446 of the phase change layer 408. In some embodiments, locating the outlet tube 438 helically around the compressor 116 may impart an additional amount of heat into the phase change material 446 as compared to an outlet tube, such as outlet tube 238 in FIG. 2 that exits straight from the compressor 116 and may only impart a nominal amount of heat into a phase change material 446. In some embodiments, locating the outlet tube 438 immediately below the phase change layer 408 may impart heat into the phase change material 446 located in a lower portion of the phase change layer 408. Accordingly, in such embodiments, buoyancy may distribute the heat contained within the phase change material 446 throughout the phase change layer 408. More specifically, portions of the phase change material 446 comprising higher temperatures may rise to an upper region of the phase change cavity 444, while portions of the phase change material 446 comprising lower temperatures may fall to a lower region of the phase change cavity 444. Additionally, in such embodiments, a minimum amount of additional outlet tube 438 length may be needed to substantially impart heat into the phase change material 446 as compared to a straight-exiting outlet tube, such as outlet tube 238 in FIG. 2. In some embodiments, additional heat imparted by the helically-wound outlet tube 438 may enable the phase change material 446 to continuously omit a higher thermal energy output as compared to a phase change layer that did not receive additional heat from the outlet tube 438. Additionally, in some embodiments, the phase change material 346 may comprise the ability to continuously output a thermal energy output for a longer period of time as compared to a phase change layer that did not receive additional heat from the outlet tube 438.

Figure 5:
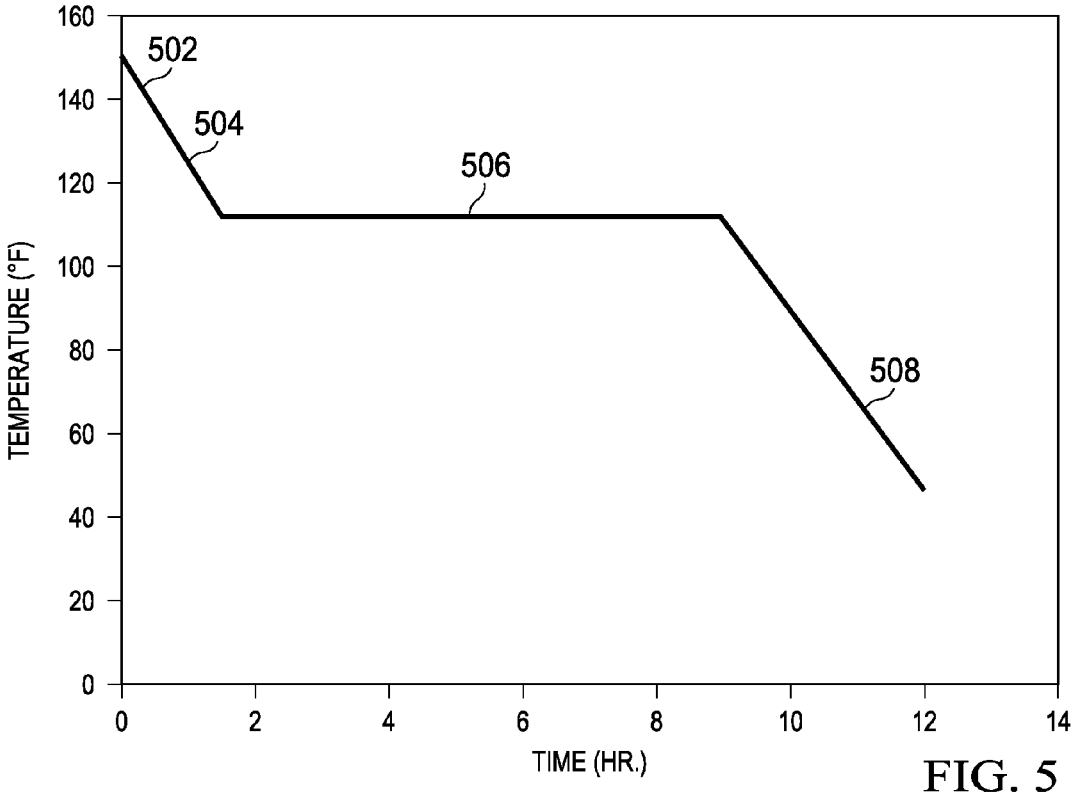
FIG. 5 is a chart of the temperature profile of a phase change compressor cover according to an embodiment of the disclosure.

Referring now to FIG. 5, a chart 500 of a temperature profile 502 of a phase change compressor cover 200, 300, 400 is shown according to an embodiment of the disclosure. The chart 500 comprises a y-axis that depicts the temperature of a phase change compressor cover 200, 300, 400 in degrees Fahrenheit and also comprises an x-axis that depicts an elapsed time of thermal energy discharge. In this embodiment, the phase change compressor cover 200, 300, 400 comprises a phase change material 246, 346, 446, respectively, that is paraffin wax comprising a 1 inch thickness. A temperature profile 502 is plotted on the chart 500 and illustrates the temperature (y-axis) of the paraffin wax with respect to time (x-axis) as the paraffin wax discharged a continuous 40 Watts of thermal energy. As previously stated, a refrigerant exiting the compressor 116 and/or an outlet tube carrying the refrigerant, such as outlet tubes 228, 338, 438 may reach temperatures of about 150 degrees. As shown by first section 504, it will be appreciated that the paraffin wax has reached a temperature of about 150 degrees. The first section 504 also depicts the beginning of the 40 Watt thermal energy discharge from the paraffin wax beginning at the far left of the first section 504 at a time of 0 hours that represents when operation of the compressor 116 may be discontinued. It will be appreciated that in this embodiment, the paraffin wax has reached a temperature of about 150 degrees. At this high of a temperature, the paraffin wax may generally comprise a liquid form as it begins to dissipate heat. The first section 502 depicts the liquid-phase paraffin wax may drop from about 150 degrees to about 110 degrees in about the first two hours following cessation of operation of the compressor 116. The second section 506 may generally depict the behavior of the paraffin wax as it continuously discharges 40 Watts of thermal energy and changes from a liquid to a solid. Second section 506 depicts about a 7 hour period where the paraffin wax continuously dissipates 40 Watts of thermal energy as it changes from a liquid to a solid. Once solidified, third section 508 depicts the temperature profile as the solid-phase paraffin wax continuously discharges 40 Watts of thermal energy and cools in temperature from about 110 degrees to about 50 degrees over a time period of about 3 hours. Temperature profile 502 thus illustrates that a 1 inch thick paraffin wax layer, may in some embodiments, discharge a constant 40 Watts of thermal energy for at least about 12 hours. In some embodiments, a lower thermal energy from a 1 inch thick paraffin wax layer may be discharged for a period of time that may substantially exceed 12 hours. In some embodiments, a thermal energy discharge from a 1 inch thick paraffin wax layer may last at least several days.

Figure 6:
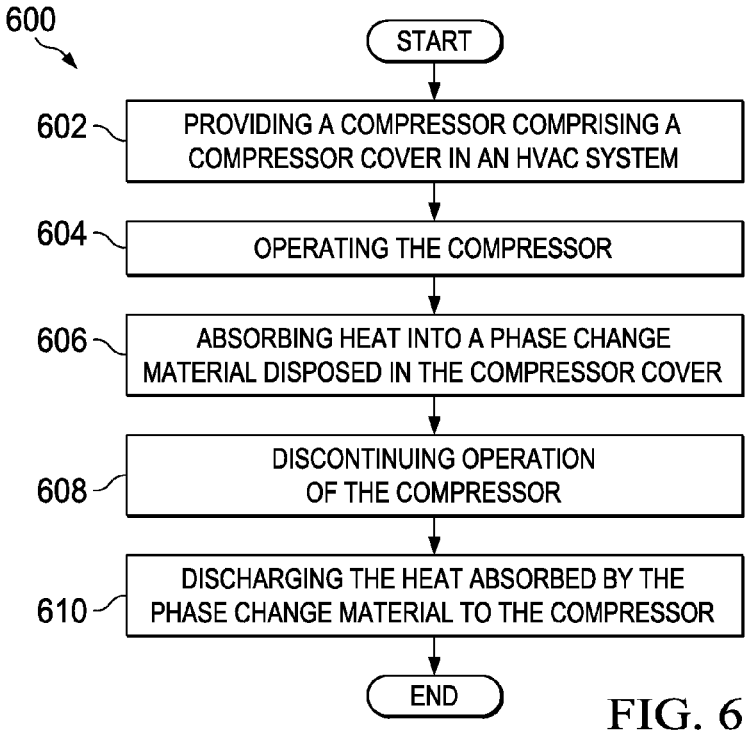
FIG. 6 is a flowchart of a method of heating a compressor according to an embodiment of the disclosure.

Referring now to FIG. 6, a flowchart of a method 600 of heating a compressor 116 is shown according to an embodiment of the disclosure. The method 600 may begin at block 602 by providing a compressor 116 comprising a compressor cover in an HVAC system 100. In some embodiments, the phase change compressor cover may be phase change compressor 200. In some embodiments, the phase change compressor cover may be phase change compressor 300. In some embodiments, the phase change compressor cover may be phase change compressor cover 400. The method 600 may continue at block 604 by operating the compressor 116. The method 600 may continue at block 606 by absorbing heat into a phase change material 246, 346, 446 of the phase change compressor cover 200, 300, 400, respectively. In some embodiments, the heat may comprise heat discharged by operation of the compressor 116. In some embodiments, the heat discharged by the compressor 116 may comprise heat discharged by a refrigerant and/or an outlet tube, such as outlet tube 338, 438. The method 600 may continue at block 608 by discontinuing operation of the compressor 116. The method 600 may conclude at block 610 by discharging the heat absorbed by the phase change material 246, 346 to the compressor 116.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l-k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Unless otherwise stated, the term "about" shall mean plus or minus 10 percent of the subsequent value. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A compressor cover, comprising:

a first layer comprising:

a first layer outer surface, a first layer inner surface, and a first layer base;

a second layer comprising:

a second layer outer wall comprising a second layer outer wall outer surface and a second layer outer wall inner surface, a second layer inner wall comprising a second layer inner wall outer surface and a second layer inner wall inner surface, and a second layer base comprising a second layer base outer surface and a second layer base inner surface; and a refrigerant discharge line, the refrigerant discharge line is configured to connect in fluid communication with a compressor and configured to carry refrigerant from the compressor and beyond the first layer outer surface, the refrigerant discharge line is configured to wind helically around the compressor between the compressor and the second layer inner wall inner surface;

wherein the second layer outer wall inner surface, the second layer inner wall outer surface, and the second layer base inner surface form a second layer cavity, and wherein the second layer cavity comprises a phase change material.

2. The compressor cover of claim 1, wherein the first layer and the second layer comprise substantially complimentary shapes.

3. The compressor cover of claim 2, wherein the second layer outer wall outer surface substantially abuts the first layer inner surface.

4. The compressor cover of claim 3, wherein the first layer and the second layer are configured to substantially envelope the compressor.

5. The compressor cover of claim 1, wherein at least one of the first layer and the second layer comprise fiberglass.

6. The compressor cover of claim 1, wherein the phase change material is configured to absorb heat discharged by the compressor.

7. The compressor cover of claim 1, wherein the phase change material comprises paraffin wax.

8. The compressor cover of claim 1, wherein the second layer comprises a thickness of at least one of (1) about ½", (2) about ¾", (3) about 1", (4) about 1.25", and (5) about 1.5".

9. The compressor cover of claim 1, wherein the phase change material is configured to discharge a continuous amount of heat for a time period of at least one of at least about 6 hours, at least about 12 hours, at least about 18 hours, at least about 24 hours, at least about 36 hours, and at least about 48 hours.

10. A compressor, comprising:

a compressor cover comprising:

a refrigerant discharge line;

a first layer comprising:

a first layer outer surface, a first layer inner surface, and a first layer base; and a second layer comprising:

a second layer outer wall comprising a second layer outer wall outer surface and a second layer outer wall inner surface, a second layer inner wall comprising a second layer inner wall outer surface and a second layer inner wall inner surface, and a second layer base comprising a second layer base outer surface and a second layer base inner surface;

the second layer outer wall inner surface, the second layer inner wall outer surface, and the second layer base inner surface form a second layer cavity, the first layer and the second layer are configured to substantially envelope the compressor, the second layer cavity comprises a phase change material, wherein the refrigerant discharge line is connected in fluid communication with the compressor and configured to carry refrigerant from the compressor and beyond the first layer outer surface of the compressor cover, and wherein the refrigerant discharge line is helically wound around the compressor between the compressor and the second layer inner wall inner surface.

11. The compressor of claim 10, wherein the second layer outer wall outer surface substantially abuts the first layer inner surface.

12. The compressor of claim 10, wherein at least one of the first layer and the second layer comprise fiberglass.

13. The compressor of claim 10, wherein the phase change material is configured to absorb heat discharged as a result of operating the compressor.

14. The compressor of claim 10, wherein the phase change material comprises paraffin wax.

15. The compressor of claim 10, wherein the second layer comprises a thickness of at least one of (1) about ½", (2) about ¾", (3) about 1", (4) about 1.25", and (5) about 1.5".

16. The compressor of claim 10, wherein the phase change material is configured to discharge a continuous amount of heat to the compressor for a time period of at least one of at least about 6 hours, at least about 12 hours, at least about 18 hours, at least about 24 hours, at least about 36 hours, and at least about 48 hours.

17. A method of heating a compressor, comprising:

providing a compressor comprising a compressor cover, the compressor cover comprising a first layer and a second layer that substantially envelopes the compressor and a refrigerant discharge line connected in fluid communication with the compressor and wound helically around the compressor between the compressor and the second layer;

operating the compressor;

absorbing heat discharged as a result of operating the compressor into the compressor cover using a phase change material disposed in a cavity within the second layer of the compressor cover; and discharging heat from the compressor cover.

18. The method of claim 17, wherein the discharging heat from the compressor cover to the compressor is accomplished using the refrigerant discharge line and enables the phase change material to omit a higher thermal energy output than if the refrigerant discharge line did not wind helically around the compressor.

19. The method of claim 18, wherein the discharging heat from the compressor cover is accomplished in response to discontinuing operation of the compressor by discharging the heat absorbed by the phase change material.

20. A heating air conditioning and/or ventilation (HVAC) system, comprising:

a compressor comprising a base configured to accommodate pooled refrigerant; and a compressor cover comprising a first layer and a second layer at least partially enveloping the base and a refrigerant discharge line connected in fluid communication with the compressor and would helically around the compressor between the compressor and the second layer, wherein the compressor cover comprises a phase change material disposed in a cavity within the second layer and configured to selectively change phases in response to exposure to heat generated by the compressor.

21. The HVAC system of claim 20, wherein the phase change material comprises a wax.

22. The HVAC system of claim 21, wherein the phase change material comprises a paraffin wax.

23. The HVAC system of claim 20, wherein the compressor cover substantially surrounds at least the lateral sides of the compressor.

24. The HVAC system of claim 20, wherein the compressor cover substantially surrounds at least a top of the compressor.

25. The HVAC system of claim 20, wherein the compressor cover substantially covers at least a bottom of the compressor.

* * * * *